US006461115B1

(12) United States Patent
Ferrier et al.

(10) Patent No.: US 6,461,115 B1
(45) Date of Patent: Oct. 8, 2002

(54) SUCTION CHAMBER FOR A HORIZONTAL PUMPING SYSTEM

(75) Inventors: Neil Ferrier, Oklahoma City, OK (US); Stephen M. Sakamoto, Oklahoma City, OK (US)

(73) Assignee: Wood Group ESP, Inc., Oklahoma City, OK (US)

( * ) Notice: Subject to any disclaimer, the term of this patent is extended or adjusted under 35 U.S.C. 154(b) by 83 days.

(21) Appl. No.: 09/697,606

(22) Filed: Oct. 25, 2000

(51) Int. Cl.[7] ..... F04B 19/24

(52) U.S. Cl. ..... 417/53; 417/423.11; 417/360; 277/268; 277/3

(58) Field of Search ..... 417/53, 423.11, 417/360, 365

(56) References Cited

U.S. PATENT DOCUMENTS 5,340,273 A * 8/1994 Rockwood ..... 415/113
6,196,813 B1 * 3/2001 Turley et al. ..... 417/423.12
RE37,233 E * 6/2001 Chancellor et al. ..... 417/423.7

OTHER PUBLICATIONS

FIGS. 2 and 3 of the present application show prior art suction chambers.

* cited by examiner

*Primary Examiner*—Charles G. Freay
*Assistant Examiner*—William Rodriguez
(74) *Attorney, Agent, or Firm*—McAfee & Taft

(57) ABSTRACT

A suction chamber for use in a pumping system has a motor and a pump. The suction chamber is positioned between the motor and the pump in the pumping system and has a seal assembly. The seal assembly seals the shaft to prevent fluid from leaking through a motor end of the suction chamber. The seal assembly may be removed and replaced through the pump, or wet end of the suction chamber so that any parts, including thrust bearing chamber and/or the motor positioned on the motor end of the suction chamber are not moved during the removal and replacement of the sealing assembly. This permits removal and replacement of the sealing assembly without necessitating the need for realigning the motor, thrust bearing chamber and other parts on the motor side of the suction chamber which alleviates the risk of vibration that might occur due to the removal and then improper realignment of the motor, bearings and/or other equipment on the motor side of the suction chamber.

20 Claims, 4 Drawing Sheets

SUCTION CHAMBER FOR A HORIZONTAL PUMPING SYSTEM

BACKGROUND OF THE INVENTION

The present invention relates generally to pumping systems, and more particularly to a suction chamber utilized with horizontal pumping systems.

It is well known that horizontal pumping systems are utilized in a variety of industries for a variety of different purposes. For example, in the oil and gas industry horizontal pumping systems are utilized to pump fluid, typically water that has been separated from oil to a selected destination, such as a tank or disposal well. Such pumping systems typically include a pump, a motor and a suction chamber positioned therebetween. A thrust bearing chamber is also generally included between the suction chamber and the motor. The fluid to be moved by the pump is drawn into the system through the suction chamber. The fluid is pumped through the discharge head of the pump, which may have a flexible hose or other pipe removably connected thereto. The fluid will pass through the hose and/or the connecting pipe into the tank or other desired reservoir.

The suction chamber includes a shaft sealing device which prevents fluid from leaking out the motor or thrust bearing chamber end of the suction chamber. Fluid leaks through the motor end of the suction chamber can contaminate the thrust bearing chamber and/or the motor and cause significant damage thereto. The sealing device in the suction chamber will wear over time, and therefore must be replaced periodically to prevent leakage. There are two types of sealing devices used in suction chambers, typically referred to as component seals and cartridge seals. Component seals are made up of a number of individual components, such as rings and adapters, snap rings and the seal element. To replace component seals, the pump is disconnected from the suction chamber, and each piece is removed individually. The procedure is therefore a delicate one which is time consuming and difficult, and requires considerable experience.

Cartridge seals, on the other hand, are preassembled seal assemblies that can be removed and replaced as an assembled unit.

The present method for replacing cartridge seals is to remove the cartridge seal from the motor or bearing end of the suction chamber. Typically, the thrust bearing chamber is disconnected from the pumping system and access is gained to the suction chamber through the motor end of the suction chamber. It is sometimes necessary to move the motor as well. Such a procedure is acceptable with respect to relatively short pumping systems and in situations where it is necessary or desired to remove the thrust bearing chamber. However, there are circumstances where it is desired to leave intact the motor, the bearing and any other equipment positioned on the motor side of the suction chamber.

For example, in some horizontal pumping systems, the motor may be a very large motor which may be mounted to a platform or other structure. A shaft extends horizontally from the motor and the bearing is supported at a particular height so as to prevent or at least to keep to a minimum any vibration experienced in the system. The suction chamber is connected in the pumping system forward of the thrust bearing chamber and the pump is connected to the suction chamber. The direction forward as referred to herein means the direction from the motor toward the pump and the direction backward is the opposite direction (i.e., from the pump to the motor). Whenever reference is made to the pump end or pump side of any piece of equipment it simply refers to the end or side of that piece of equipment closest to the pump. Likewise, reference to the motor end or motor side of a piece of equipment indicates reference to the end side of the equipment closest to the motor. The pump will typically be supported by a plurality of supports to keep the pump at a desired height. When the motor and/or the equipment between the motor and the suction chamber is disconnected, there is a likelihood that when that equipment is replaced and put back into service, it will be difficult to realign the motor and the thrust bearing chamber in such a way as to prevent vibration. In other words, by disconnecting and moving the thrust bearing chamber and/or the motor, it is likely that increased vibration will exist over what is desired. Thus there is a need for a method and apparatus which will provide for the replacement of cartridge seals in the suction chamber so as to prevent leakage from the suction chamber, which can be done without disturbing the equipment on the motor side of the suction chamber. There is likewise a need for a method and apparatus which will provide for replacement of the cartridge seal and which eliminates or at least alleviates the problem of increased vibration due to removal and attempted realignment of the motor and other equipment on the motor side of the suction chamber.

SUMMARY OF THE INVENTION

The present invention provides a suction chamber for use with a fluid pumping system and more particularly a suction chamber for use in a horizontal pumping system. The suction chamber is positioned between the motor and a pump in the horizontal pumping system. The pumping system may also include a thrust bearing chamber positioned between the motor and the suction chamber. The suction chamber has a pump end and a motor end and includes a housing. A cartridge seal assembly is disposed in the housing. A shaft extends from the thrust bearing chamber through the suction chamber and into the pump. The sealing assembly is disposed about the shaft in the suction chamber.

The suction chamber includes a removable end plate at the pump end thereof. The end plate along with the pump at the pump end of the suction chamber may be moved relative to the suction chamber so that access to the interior of the chamber can be gained through the pump end of the suction chamber. The sealing assembly is connected in the housing with a connecting means that is easily accessible from the pump end of the suction chamber. The connecting means may comprise fasteners extending through the pump side of the sealing assembly into the housing. The fasteners are easily accessible and removable from the pump end of the suction chamber.

Once access to the interior of the suction chamber has been gained through the pump end thereof, and the fasteners removed, the sealing assembly will simply slide off of the shaft. The removed sealing device can be replaced with a new sealing device that will prevent leaks through the motor end of the suction chamber. Once the new sealing device is in place, fasteners or other connecting means can be reinstalled and the pump can be reconnected to the pump end of the suction chamber. Once all the connections are made, the pumping system may be placed back in service and fluid can be drawn in through the suction chamber and delivered to the pump which will deliver the fluid to a desired location.

The present invention thus provides an apparatus and method for removing and replacing the sealing assembly of a suction chamber without disconnecting or disturbing the equipment positioned on the motor side of the suction chamber. By removing and replacing the sealing assembly through the pump end of the suction chamber, the motor and the thrust bearing chamber on the motor side of the suction chamber can be left intact and the risk of misalignment of the motor and thrust bearing chamber, which will cause undue and excessive vibration, is eliminated.

The foregoing summary, as well as the following detailed description of the preferred embodiments of the invention, will be better understood when read in conjunction with the appended drawings.

BRIEF DESCRIPTION OF THE DRAWINGS

FIG. 1A shows a side view of the pumping system of FIG. 1.

DETAILED DESCRIPTION OF A PREFERRED EMBODIMENT

Figure 1:
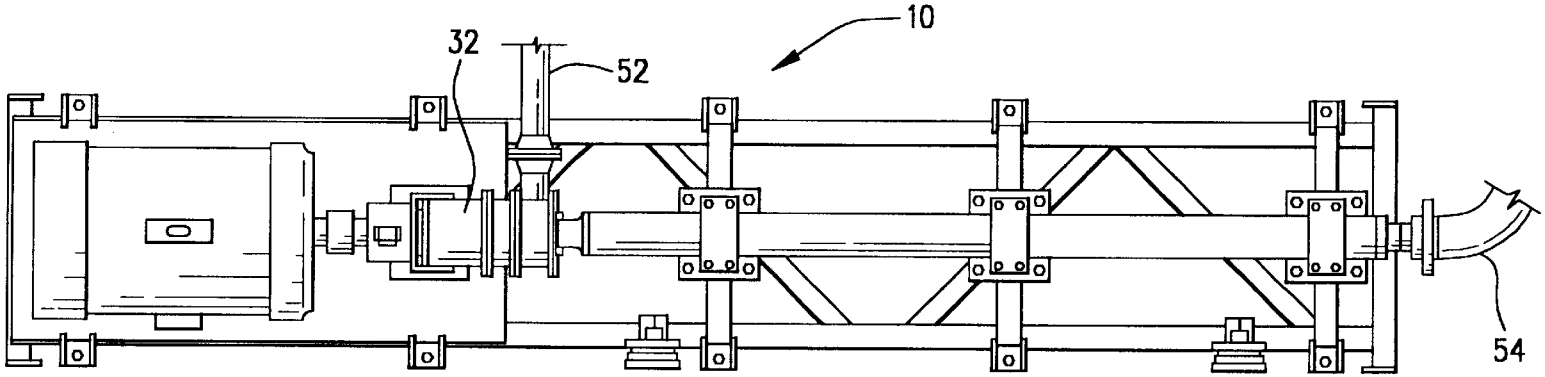
FIG. 1 schematically shows a top view of a pumping system including a motor, a pump and the suction chamber of the present invention.

In the description that follows, like parts are marked throughout the specification and drawings with the same reference numerals respectively. As provided above, the forward direction as referred to herein is the direction from the motor toward the discharge end of the pump and rear, or rearward is the opposite direction. Reference to the pump end, or pump side of a piece of equipment simply means the end or side closest to the pump, and reference to a motor end or motor side means the end or side closest to the motor.

Referring to the drawings and more particularly to FIG. 1, a pumping system 10 including the suction chamber of the present invention is schematically shown. Pumping system 10 is a horizontal pumping system that comprises a motor 15, suction chamber 20 and pump 25. Motor 15 may be mounted to a platform 30. The pumping system further includes a thrust bearing chamber 32. Thrust bearing chamber 32 may be connected to a bearing chamber adapter 34 which is in turn connected to suction chamber 20. Pumping system 10 may also include a vibration sensor 36. A drive shaft 38 extends forward from motor 15. The drive shaft 38 may be comprised of a plurality of sections 40 which may be connected to one another by couplings 42 or by other means known in the art. Shaft sections 40 and couplings 42 may be of differing sizes and can be of any type known in the art. The drive shaft 38 will extend from motor 15 through thrust bearing chamber 32, suction chamber 20 and into pump 25. Thrust bearing chamber 32 is supported by a bearing chamber support 44.

Pump 25 has an inlet end 46 which is connected to suction chamber 20 and a discharge end 48. Pump 25 is supported by a plurality of supports 47. A discharge head 50 may be connected at discharge end 48. The operation of the system is as follows. Suction chamber 20 is connected to an inlet pipe 52 which will deliver fluid to the system. The fluid may be but is not limited to water which has been separated from oil that has been produced from a well. The water or other fluid passes through suction chamber 20 into pump 25 and out the discharge end thereof into a discharge pipe 54 which may be a flexible hose, a flexible coupling or other type of discharge pipe. The fluid can be delivered to a tank, a disposal well or any other desired reservoir or location. If the fluid being delivered by the pumping system begins to leak in a direction toward the motor, the thrust bearing chamber and in some cases the motor itself which may be in closer proximity than is shown in FIGS. 1 and 1A can be damaged. Such leaks may also cause environmental contamination. It is therefore necessary to remove and replace the sealing device to prevent such leakage.

Figure 2:
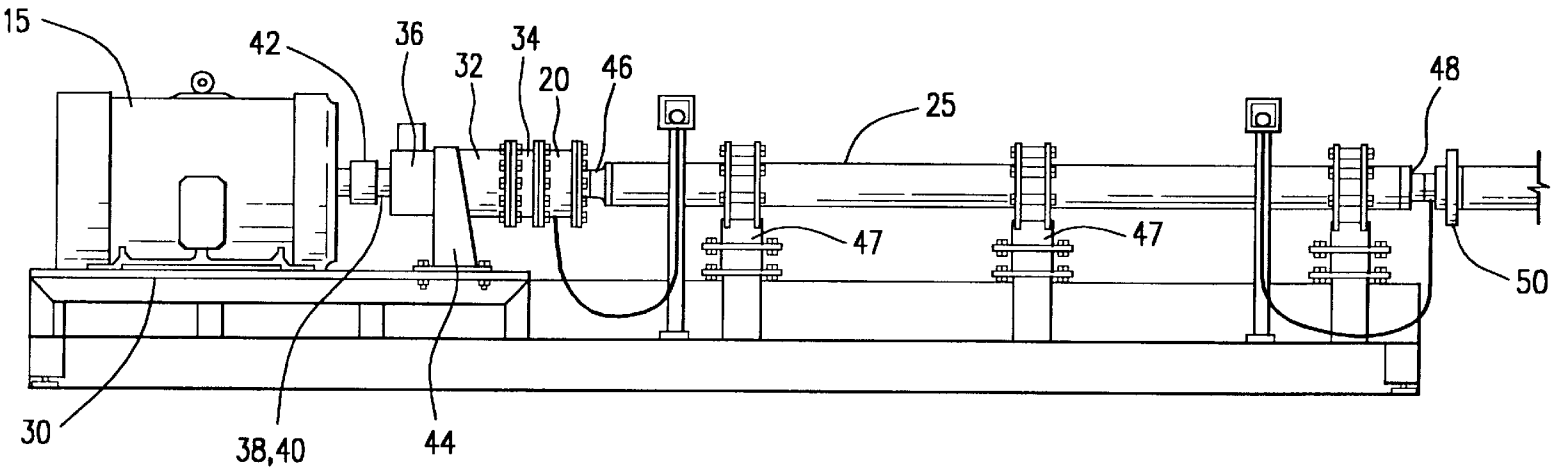
FIGS. 2 and 3 show section views of prior art suction chambers.
Figure 2:
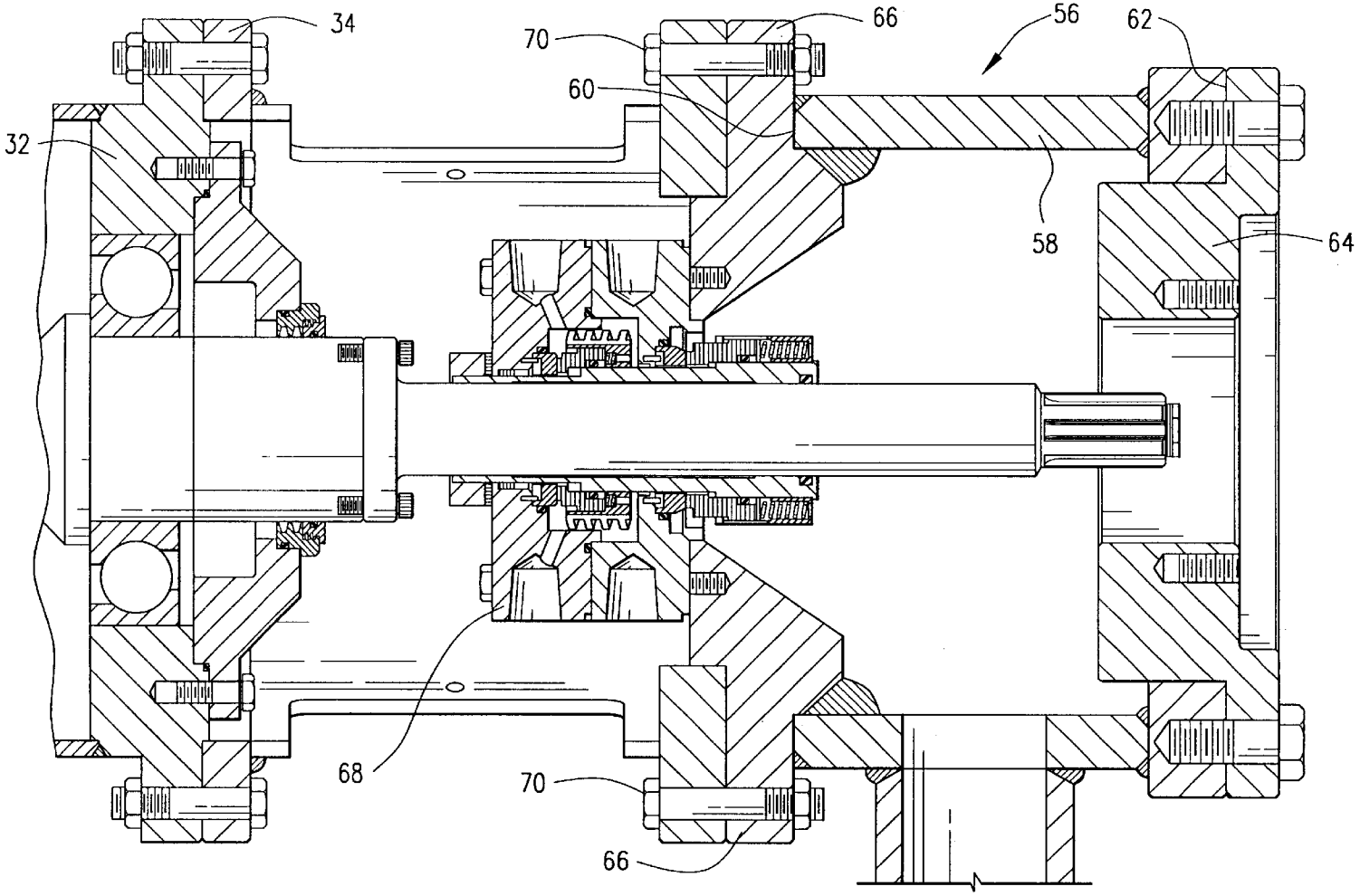
FIG. 2 PRIOR ART
Figure 3:
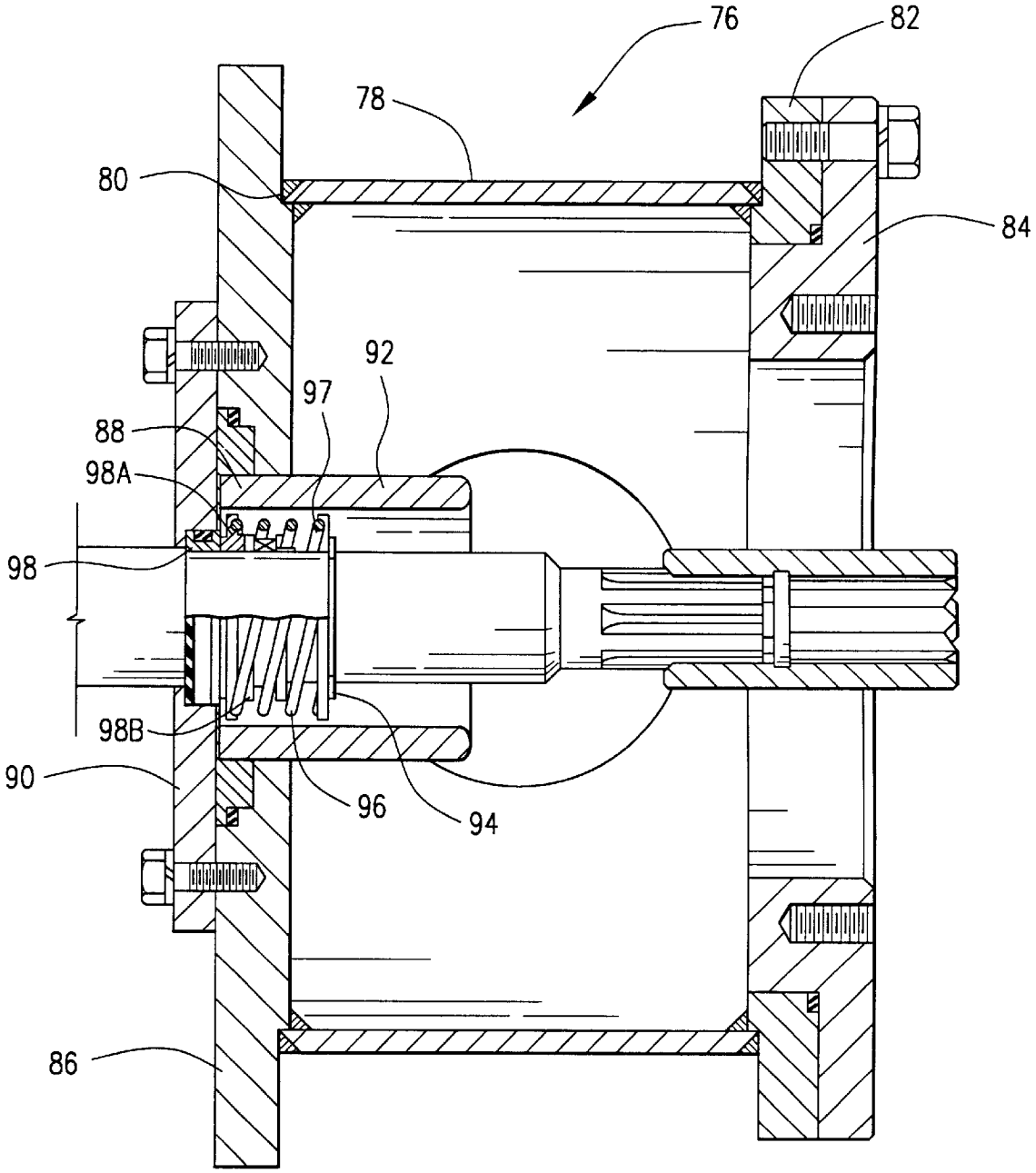
FIG. 3 PRIOR ART

Referring now to FIGS. 2 and 3, prior art suction chambers are shown. FIG. 2 shows a suction chamber 56 comprising a housing 58 having a motor or bearing end 60 and a pump or wet end 62. An end plate 64 which may be referred to as a pump adapter plate 64 is disposed at pump end 62. An end plate 66 is connected at motor end 60. A cartridge seal 68 is connected to end plate 66 at the motor end of housing 58. Cartridge seal 68 is connected to end plate 66 with fasteners. A bearing chamber adapter 34 may be connected to suction chamber 56 with bolts 70.

Cartridge seal 68 prevents fluid from passing through motor end 60 and thus prevents any damage to the thrust bearing chamber or motor because of contamination from the fluid. When a suction chamber like chamber 56 is utilized in connection with pumping systems like that set forth in FIGS. 1 and 1A, it is necessary to disconnect the thrust bearing chamber 32 and the bearing chamber adapter housing 34, and to disconnect the shaft sections at, among other places, the coupling between the motor and the thrust bearing chamber 32. All of this equipment must be moved toward the motor and thus the thrust bearing chamber 32 must be disconnected from the bearing chamber support 44. Once all of this is accomplished, the cartridge seal can be replaced with a new or a repaired seal and the thrust bearing chamber, bearing chamber adapter and other equipment that has been removed and/or disconnected can be reconnected. By disconnecting and reconnecting the equipment including the motor and/or the equipment between the motor and the suction chamber 56 it is likely that increased vibration will occur making it necessary to take further time to realign and bring the vibration within an acceptable level. As is well known in the art, vibration can cause equipment to wear and fail prematurely.

An additional embodiment of a prior art suction chamber is shown in FIG. 3. FIG. 3 shows a suction chamber 76 comprising a housing 78 having a motor end 80 and a pump end 82. A pump adapter plate 84 is connected at the pump end and a motor end end plate 86 is fixedly and nonremovably attached at the motor end 80. A component seal 88 is disposed in the interior of suction chamber 76. A seal plate 90 is attached to end plate 86. Component seal 88 consists of a seal ring or similar cover 92, a snap ring 94 and a mechanical seal 96, which may include a seal spring 97, a stationary sealing seat 98, a rotary sealing face 98A, and a seal retainer 98B, as well as other miscellaneous mostly elastomeric sealing and retaining devices. To remove and replace seal 88, pump adapter plate 84 must be removed. Seal ring 92 can then be removed, and snap ring 94 can be removed after seal ring 92. Seal spring 97, stationary sealing seat 98, rotary sealing face 98A, and seal retainer 98B, as well as other miscellaneous mostly elastomeric sealing and retaining devices can then be removed over the shaft. The seal must be replaced in the same way it is removed, namely one component at a time. Because each component must be removed and replaced as a separate piece, the procedure is time consuming, and requires considerable time, experience, and dexterity. Any contamination of the sealing faces or damage to any individual component will usually result in the seal failing to operate correctly or for a reduced time period.

Figure 4:
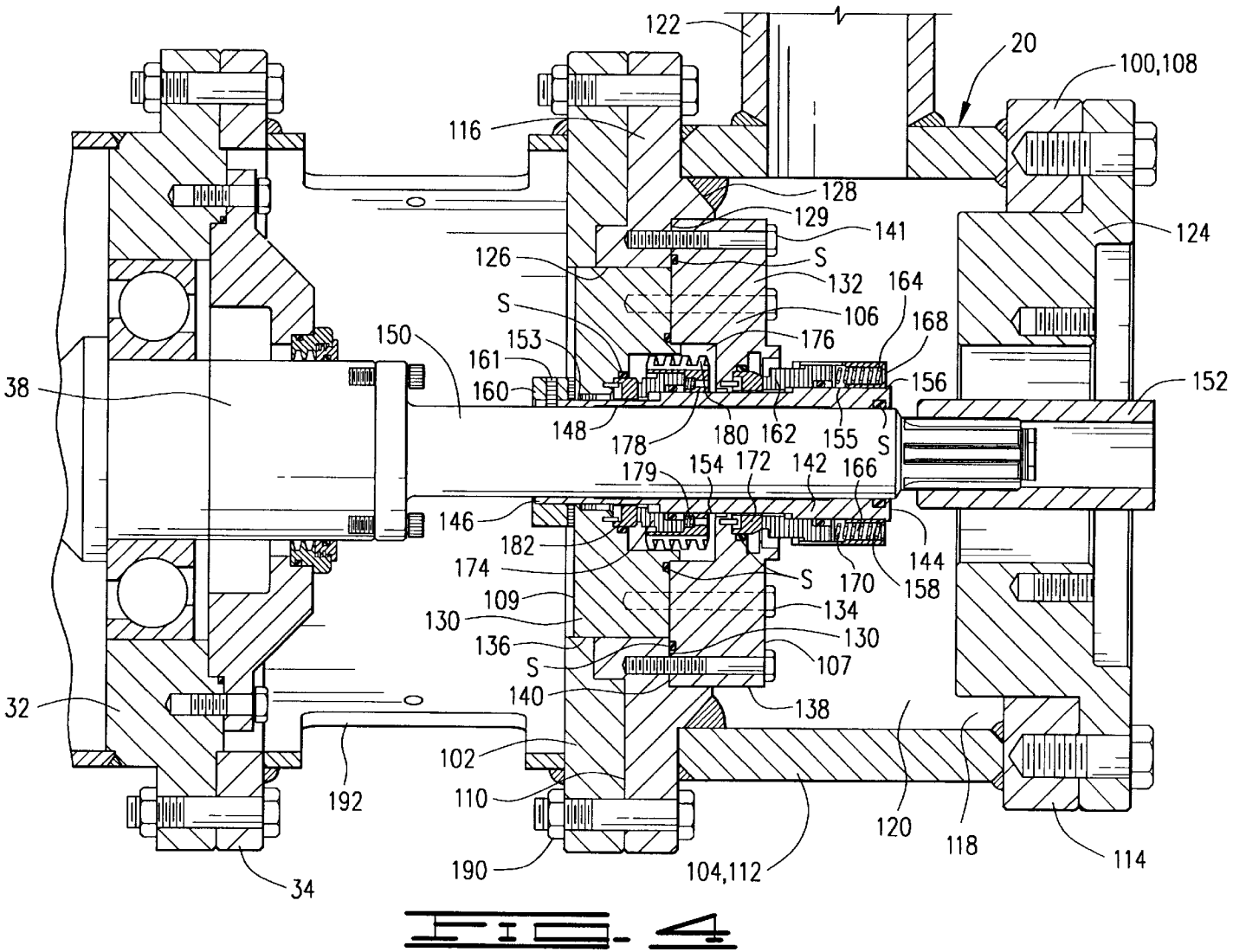
FIG. 4 is a section view of the suction chamber of the present invention with a thrust bearing chamber adapter connected to the motor end of the suction chamber.

Referring now to FIG. 4, the suction chamber 20 of the present invention is shown. Suction chamber 20 has a pump or wet end 100 and a thrust bearing chamber or motor end 102. Suction chamber 20 comprises a housing 104 and a sealing device or sealing assembly 106. Seal assembly 106 which may be referred to as a cartridge seal 106, has a forward or pump side 107 and a rear or motor side 109.

Housing 104 has a pump or wet end or side 108 and a motor or thrust bearing chamber end or side 110. Housing 104 comprises a central portion 112, a reinforcing end ring 114 connected by welding or other means known in the art at the wet end of the housing to central portion 112 and an end cap or end plate 116 connected by welding or other means to central portion 112 at the motor end of housing 104. Housing 104 defines an interior 118, and has an opening 120 defined therethrough in central portion 112. An inlet 122 is connected to housing 104. Inlet 122 is adapted to be connected to inlet pipe 52 to communicate fluids from inlet pipe 52 therethrough into interior 118 of housing 104. A pump adapter plate 124 may be connected to end ring 114 so that a pump, for example pump 25 may be connected thereto and extend forward therefrom.

End plate 116 defines a first inner diameter 126 and a second inner diameter 128 displaced radially outwardly therefrom. A shoulder 129 is defined by and extends between diameters 126 and 128. Cartridge seal 106 is disposed in the interior of housing 104 and comprises a first or rear seal plate 130 and a second or forward seal plate 132. First and second seal plates 130 and 132 may be connected to each other with fasteners 134 or other means known in the art. First seal plate 130 defines a first outer diameter 136 and second seal plate 132 defines a second outer diameter 138. A rear-facing shoulder 140 is defined by and extends between first and second outer diameters 136 and 138 on seal assembly 106. Seal assembly 106 is attached to housing 104 with fasteners 141 which extend through forward side 107 and through shoulder 129 between first and second inner diameters 126 and 128.

Seal assembly 106 further includes a seal sleeve 142 having a forward end 144 and a rear end 146. Seal sleeve 142 defines a central opening 148 which is adapted to receive a shaft such as drive shaft 38. The section 40 of the shaft shown in FIG. 4 may be referred to as a drive shaft section 150 for ease of reference. The coupling 42 at the forward end of shaft section 150 may be referred to as coupling 152. When the suction chamber is connected in pumping system 10, an additional shaft section will be connected to and will extend forward from coupling 152.

Sleeve 142 defines first outer diameter 153, second outer diameter 154, third outer diameter 155 and fourth outer diameter 156. A lip or shoulder 158 is defined by and extends between third and fourth outer diameters 155 and 156 respectively. A collar 160 is disposed about sleeve 142 at the rear end thereof. A set screw 161 may extend through collar 160 and sleeve 142, so that sleeve 142 will rotate with the shaft.

A first or forward primary seal ring 162 is disposed about sleeve 142 and preferably about the second and third outer diameters thereof. A retainer 164 is disposed about a forward portion of seal 162 and is positioned rearwardly of and held in place by lip 158. A spring or plurality of springs 166 are disposed in retainer 164. Spring(s) 166 has a forward end 168 that engages retainer 164 and has a rear end 170 that engages and holds primary seal ring 162 in place. A first, or forward mating ring 172 is disposed about sleeve 164 rearwardly of and engages a rear end of first primary seal ring 162. A second, or rear primary seal ring 174 is disposed about sleeve 142 and preferably about first and second outer diameters 153 and 154. Second primary seal ring 174 is preferably disposed in an interior 176 defined by seal plates 130 and 132. A retainer 178 is likewise disposed in interior 176 and is disposed about second primary seal ring 174. A spring 179 is disposed in retainer 178 and engages a forward end of second primary seal 174 to keep a rear end of second primary seal 174 in engagement with a second mating ring 182 disposed about sleeve 142 in interior 176. Interior 176 is filled with a barrier fluid, usually a light oil, and the barrier fluid is circulated through the interior 176 by a pumping ring 180. There are gland connections (inlet/oulet) on the motor side 109 of the plate 130, so that the barrier fluid may be circulated through an external reservoir. A plurality of O-ring seals are included in seal assembly 106 and are simply designated by the numeral S. The O-ring seals may be of any material known and utilized in the art for such purposes. Likewise, the material utilized for primary seal rings 162 and 174 and for mating rings 172 and 182 may be of any material known in the art utilized for such purposes. Preferably, primary seal rings 162 and 174 and mating rings 172 and 182 are comprised of silicon carbide.

In the embodiment shown in FIG. 4, the shaft section 40 may be referred to as a shaft section 150, and is shown connected to an additional shaft section 40 that extends rearwardly therefrom. Bearing housing adapter 34 is shown connected with bolts 190 to suction chamber 20. Bearing housing adapter 34 has openings 192 to provide access to the motor end of seal assembly 106 in suction chamber 20 and thus to set screw 161 and gland connections on the motor side of seal. Bearing housing adapter 34 is shown connected to thrust bearing chamber assembly 32. Although the connections shown herein are with bolts, the connections may be made with any type of fastener or other means known in the art.

The operation of the pumping system is apparent from the drawings. Fluid is drawn in to suction chamber 20 through inlet 122. The fluid is urged forwardly through pump 25 into discharge pipe 54 and can be delivered to any desired location. Sealing assembly 106 prevents fluid, such as water from leaking through the motor end of suction chamber 20. After a time, when seals in the sealing assembly 106 become worn or other damage occurs, the seal assembly must be replaced. To do so, pump 25, which will be attached to adapter plate 124 can be disconnected and moved in the forward direction. The bolts that hold pump adapter plate 124 can then be removed and pump adapter plate 124 can be removed to gain access to the interior of suction chamber 20. If desired, pump 25 may be left attached to pump adapter plate 124 and the bolts holding adapter plate 124 can be removed so that the adapter plate 124 is removed with the pump. The shaft section which extends forward from coupling 152 will simply slide from the coupling 152.

Prior to moving pump 25 the bolts or other fasteners which hold pump 25 stationary in pump supports 47 will have to be loosened and/or removed so that the pump can be moved. Once the pump is loose from the pump supports and has been disconnected from the pump end of the suction chamber 20, it can be moved a sufficient distance so that access to the interior of suction chamber 20 is gained. Once access to chamber 20 has been. gained bolts 141, which may be referred to as a means for connecting the cartridge seal to housing 104, can be removed. Once set screws 161 are loosened, cartridge seal 106 can then simply be removed in its assembled condition through the open pump end of housing 104 of suction chamber 20. The cartridge seal can be repaired, and/or replaced with a new cartridge that will prevent leakage or that will at least alleviate leakage to prevent damage to equipment such as the thrust bearing chamber and motor positioned at the motor side of the suction chamber. The pump adapter plate 124 along with the pump can then be reconnected and the pump can be resecured to the pump supports.

Thus, the suction chamber of the present invention provides an apparatus and method for removing and replacing the shaft sealing assembly in suction chambers through the forward or pump end of the suction chamber. The sealing assembly can be removed without disconnecting or disturbing the equipment on the motor side of the suction chamber, such as the motor and/or thrust bearing chamber positioned on the motor side of the suction chamber. The invention likewise provides a method for removing and replacing the sealing assembly in a suction chamber while eliminating the risk of increased vibration due to improper realignment of parts positioned on the motor side of the suction chamber. Thus, the invention is able to meet all of the objectives described. Further, while a particular type of cartridge seal has been shown and described, the term cartridge seal as referred to herein includes seal assemblies that can be preassembled and can be removed and replaced from the suction chamber as an assembled unit.

The foregoing description and drawings of the invention are explanatory and illustrative thereof, and various changes in sizes, shapes, materials and arrangement of parts, as well as certain details of the illustrated construction may be made within the scope of the appended claim without departing from the true spirit of the invention. Accordingly, while the present invention has been described herein in detail to its preferred embodiment, it is to be understood that this disclosure is only illustrative and exemplary of the present invention and is made merely for the purposes of providing and enabling disclosure of the invention. The foregoing disclosure is neither intended nor to be construed to limit the present invention or otherwise to exclude any such embodiments, adaptations, variations, modifications, and equivalent arrangements, the present invention being limited only by the claims appended hereto and the equivalents thereof.

What is claimed is:

1. A method of repairing a suction chamber used with fluid pumping systems to prevent leakage of a pumped fluid through a motor end of the suction chamber, the suction chamber having a cartridge seal in the interior thereof and being connected in a pumping system comprising a motor, said suction chamber and a pump, the suction chamber being positioned between the motor and the pump, the method comprising:

accessing the interior of said suction chamber through a pump end thereof;

removing the cartridge seal as an assembly from said interior of said suction intake through the pump end of said suction intake; and replacing the removed cartridge seal with an assembled cartridge seal in said suction intake through the pump end thereof.

2. The method of claim 1 wherein said accessing step comprises disconnecting said pump from said pump end of said suction chamber.

3. The method of claim 2 further comprising reconnecting said pump to said suction chamber after replacing the cartridge seal.

4. The method of claim 1, said suction chamber having an end plate at the pump end thereof, said accessing step comprising removing said end plate from said pump end of said suction intake.

5. A suction chamber for use in a pumping system having a motor, said suction chamber, and a pump, the suction chamber comprising:

a housing defining a housing interior;

the housing having a pump end and a motor end, and having a removable end plate at the pump end thereof and an end plate at the motor end thereof;

a fluid inlet for receiving and communicating a fluid with said housing interior; and a removable seal assembly disposed in said housing interior for preventing said fluid from leaking through said motor end of said housing, said seal assembly having a central opening for receiving a drive shaft extending from said motor to said pump, wherein said removable end plate may be disconnected from said pump end of said housing and said seal assembly removed in its assembled condition through said pump end of said housing.

6. The suction chamber of claim 5, wherein said seal assembly extends from said interior of said housing into an opening defined by said end plate at the motor end of said housing.

7. The suction chamber of claim 5, further comprising a connecting means for connecting said seal assembly in said housing, said connecting means being easily accessible from said pump end of said housing.

8. The suction chamber of claim 5, said seal assembly defining first and second outer diameters having a shoulder extending therebetween, wherein said seal assembly is connected to said housing by fasteners extending from a pump side of said seal assembly through said shoulder and into said housing.

9. A pumping system comprising:

a motor;

a drive shaft rotated by said motor;

a pump driven by said drive shaft; and a suction chamber connected in said pumping system between said motor and said pump, said suction chamber comprising a housing having a seal assembly disposed therein for preventing fluid passing through said suction chamber from leaking through a motor end of said suction chamber, the seal assembly being removable and replaceable as an assembled unit from said housing through a pump end of said suction chamber.

10. The pumping system of claim 9, wherein said pump may be disconnected from said suction chamber housing to gain access to an interior thereof, said seal assembly being disposed about said shaft and slidable along said shaft toward said pump end of said suction chamber.

11. The pumping system of claim 9 further comprising a thrust bearing chamber assembly connected in said pumping system between said motor and said suction chamber.

12. The pumping system of claim 9, further comprising at least one pump support, wherein said pump may be disconnected from said support and moved relative to said suction chamber, so that access can be gained to said interior of said housing without moving any parts of said system between said motor arid said suction chamber.

13. A suction chamber for use in a pumping system having a motor, the suction chamber, and a pump, the suction chamber comprising:

a housing defining a housing interior;

the housing having a pump end and a motor end, and having a removable end plate at the pump end thereof and an end plate at the motor end thereof;

a fluid inlet for receiving and communicating a fluid with the housing interior;

a removable seal assembly disposed in the housing interior for preventing the fluid from leaking through the motor end of the housing, the seal assembly having a central opening for receiving a drive shaft extending from the motor to the pump, wherein the removable end plate may be disconnected from the pump end of the housing and the seal assembly removed through the pump end of the housing; and a connecting means for connecting the seal assembly in the housing, wherein the connecting means is easily accessible from said pump end of said housing.

14. A suction chamber for use in a pumping system having a motor, the suction chamber, and a pump, the suction chamber comprising:

a housing defining a housing interior;

the housing having a pump end and a motor end, and having a removable end plate at the pump end thereof and an end plate at the motor end thereof;

a fluid inlet for receiving and communicating a fluid with the housing interior; and a removable seal assembly disposed in the housing interior for preventing the fluid from leaking through the motor end of the housing, the seal assembly having a central opening for receiving a drive shaft extending from the motor to the pump, wherein the removable end plate may be disconnected from the pump end of the housing and the seal assembly removed through the pump end of the housing, the seal assembly defining first and second outer diameters having a shoulder extending therebetween, wherein the seal assembly is connected to the housing by fasteners extending from a pump side of the seal assembly through the shoulder and into the housing.

15. The suction chamber of claim 14, wherein said first diameter is received in an opening defined by said end plate at said motor end of said housing.

16. The suction chamber of claim 14, wherein said seal assembly comprises:

a seal sleeve defining said opening for said drive shaft;

a first seal plate disposed about said seal sleeve, said first seal plate defining said first diameter;

a second seal plate connected to said first seal plate, said second seal plate defining said second outer diameter, said first and second seal plates comprising a seal plate assembly said seal plate assembly and said seal sleeve defining an opening therebetween; and at least one sealing element disposed about said sleeve in said opening defined by said seal plate assembly and said seal sleeve.

17. A pumping system comprising:

a motor;

a drive shaft rotated by the motor;

a pump driven by the drive shaft;

a suction chamber connected in the pumping system between the motor and the pump, the suction chamber comprising a housing having a seal assembly disposed therein for preventing fluid passing through the suction chamber from leaking through a motor end of the suction chamber, the seal assembly being removable and replaceable as an assembled unit from the housing through a pump end of the suction chamber; and connecting means for connecting the seal assembly in the interior of the housing, the connecting means being easily accessible through the pump end of the suction chamber.

18. The pumping system of claim 17, wherein said connecting means comprises a plurality of fasteners extending through said seal assembly into said housing.

19. A pumping system comprising:

a motor;

a drive shaft rotated by the motor;

a pump driven by the drive shaft;

a suction chamber connected in the pumping system between the motor and the pump, the suction chamber comprising a housing having a seal assembly disposed therein for preventing fluid passing through the suction chamber from leaking through a motor end of the suction chamber, the seal assembly being removable and replaceable as an assembled unit from the housing through a pump end of the suction chamber; and a thrust bearing chamber assembly connected in the pumping system between the motor and the suction chamber wherein the seal assembly may be removed and replaced without moving the thrust bearing chamber assembly.

20. The pumping system of claim 19, further comprising a bearing chamber adapter connected between said thrust bearing chamber assembly and said suction chamber, said bearing chamber adapter having access ports therethrough for permitting access to a motor side of said suction chamber.

* * * * *

UNITED STATES PATENT AND TRADEMARK OFFICE

CERTIFICATE OF CORRECTION

PATENT NO. : 6,461,115 B1 
DATED : October 8, 2002
INVENTOR(S) : Neil Ferrier and Stephen M. Sakamoto It is certified that error appears in the above-identified patent and that said Letters Patent is hereby corrected as shown below:

Column 6,
Line 65, after "been" and before "gained," delete the period.

Column 8,
Line 64, delete "arid" and insert -- and -- therefor.

Signed and Sealed this

Eighteenth Day of February, 2003

JAMES E. ROGAN
*Director of the United States Patent and Trademark Office*